US008461455B2

(12) United States Patent
Kim

(10) Patent No.: US 8,461,455 B2
(45) Date of Patent: Jun. 11, 2013

(54) ELASTIC ELECTRIC CONTACT TERMINAL

(75) Inventor: Sun-Ki Kim, Kyeonggi-do (KR)

(73) Assignee: Joinset Co., Ltd. (KR)

( * ) Notice: Subject to any disclaimer, the term of this patent is extended or adjusted under 35 U.S.C. 154(b) by 345 days.

(21) Appl. No.: 12/839,205

(22) Filed: Jul. 19, 2010

(65) Prior Publication Data

US 2011/0266031 A1 Nov. 3, 2011

(30) Foreign Application Priority Data

Apr. 28, 2010 (KR) ..... 10-2010-0039632

(51) Int. Cl.
*H01B 5/00* (2006.01)

(52) U.S. Cl.
USPC ..... 174/126.2

(58) Field of Classification Search
USPC ..... 174/35 R, 35 GC, 52.1, 36; 439/66, 439/609, 927, 88
See application file for complete search history.

(56) References Cited

U.S. PATENT DOCUMENTS

| | | | | |
|---|---|---|---|---|
| 4,703,134 | A * | 10/1987 | Uematsu | 174/106 SC |
| 4,857,668 | A * | 8/1989 | Buonanno | 174/354 |
| 6,255,581 | B1 * | 7/2001 | Reis et al. | 174/388 |
| 7,129,421 | B2 * | 10/2006 | Reis et al. | 174/354 |
| 7,771,213 | B2 * | 8/2010 | Kim et al. | 439/83 |
| 7,931,475 | B2 * | 4/2011 | Kim et al. | 439/66 |

FOREIGN PATENT DOCUMENTS

| | | | |
|---|---|---|---|
| KR | 20-0390490 | Y1 | 7/2005 |
| KR | 10-0783588 | B1 | 12/2007 |
| KR | 10-0839893 | B1 | 6/2008 |
| WO | WO2008/004741 | A1 * | 1/2008 |

* cited by examiner

*Primary Examiner* — William H Mayo, III
(74) *Attorney, Agent, or Firm* — Locke Lord LLP; Alan B. Clement; Peter J. Fallon

(57) ABSTRACT

An elastic electric contact terminal including an elastic foam core having a sheet form, a non-foam rubber coating layer adhered to upper and lower surfaces of the elastic foam core and continued along any one side surface of the elastic foam core, and a heat-resistant polymer film, one side of which is adhered to the non-foam rubber coating layer in an enclosing manner and the other side of which is integrally formed with a metal layer.

16 Claims, 3 Drawing Sheets

ELASTIC ELECTRIC CONTACT TERMINAL

FIELD OF THE INVENTION

The present invention relates to an elastic electric contact terminal, and more particularly, to an elastic electric contact terminal capable of electrically, mechanically, and elastically connecting an electrically conductive object with a conductive pattern formed on a printed circuit board (PCB) which are facing each other. In addition, the present invention relates to a small-sized elastic electric contact terminal surface-mounted with a minimum height of reflow soldering.

DESCRIPTION OF THE RELATED ART

Elastic electric contact terminals are used to electrically and elastically connect electrically conductive objects and conductive patterns of a printed circuit board (PCB) which are facing respectively or alternately.

Besides, the elastic electric contact terminal may also be used to as any of an electrical ground, an electrical contact, an electrical adhesive tape, and an electromagnetic interference (EMI) gasket.

For such purposes, it is exemplary that the elastic electric contact terminal has a high electrical conductivity and a high recovery rate and is easily pressed with a small compressive load. The elastic electric contact terminal needs to have a low electrical contact resistance with respect to a contact object and be mounted on the contact object reliably and economically. For this, it is exemplary that the elastic electric contact terminal is surface-mounted by pick-and-place on a conductive pattern of a PCB and then reflow-soldered by a solder paste. Not limited thereto, however, the elastic electric contact terminal may be mounted by an electrically-conductive adhesive or adhesive tape.

Conventionally, a metal sheet is generally used as the elastic electric contact terminal for soldering. For example, a Be—Cu sheet having thickness of about 0.3 mm or less is bent into a predetermined shape by a press mold, blanked, and then heat-treated to increase elasticity and recovery rate. Thus-processed Be—Cu sheet is used as the elastic electric contact terminal.

For example, an elastic electric contact terminal manufactured by a metal sheet bent into a C-shape by a press mold and blanked is used as a small-sized elastic electric contact terminal. More specifically, a C-shape elastic electric contact terminal with a height of about 2.5 mm is used for an electrical ground, an EMI gasket, or an electrical contact to connect a mobile phone antenna to a circuit of a PCB.

However, the metal sheet solely constructing the elastic electric contact terminal needs bending to obtain elasticity. Height of the bent part determines height of the elastic electric contact terminal. Therefore, it is hard to manufacture an elastic electric contact terminal of about 1.5 mm or less in height.

The elastic electric contact terminal is light since it is constructed by only the thin metal sheet. Therefore, the elastic electric contact terminal may be easily moved by air supplied for surface mounting, which may cause defects during reflow soldering.

In addition, if pressed by more than a predetermined degree of force, the elastic electric contact terminal loses the elasticity and remains in the pressed form or breaks.

Furthermore, one type of the elastic electric contact terminal using the metal sheet is manufactured by one type of press mold. That is, a plurality of expensive molds are necessary to manufacture elastic electric contact terminals in various structures and sizes.

Other examples of the elastic electric contact terminal are disclosed in Korean Patents No. 0783588 and No. 839893, and Korean Utility Model No. 390490.

FIGS. 1A and 1B show the elastic electric contact terminals according to Korean Patents No. 0783588 and No. 839893, respectively.

As shown in the drawings, a heat-resistant polymer film 30 integrally including a metal layer 40 on a rear side thereof is adhered to a non-foam insulating rubber coating layer 20, almost entirely enclosing an insulating foam rubber core 10 or an insulating non-foam rubber core 50 having a tube form, except front and rear end parts of the elastic electric contact terminal with respect to a length direction.

However, with the above structure, an elastic electric contact terminal is hard to have a smaller size, more specifically, within a width of about 3.0 mm and a height of about 2.2 mm. To be more specific, the insulating foam rubber core 10 of FIG. 1A has a narrow width and a low height. The insulating foam rubber core 10 has a low hardness and a high recovery rate due to its material characteristics and, accordingly, has a low tensile strength and a high elongation. Therefore, it is difficult to thoroughly enclose the insulating foam rubber core 10 by the heat-resistant polymer film 30 which includes the metal layer 40 on the rear side thereof. Also, it is difficult to dispose both ends of the heat-resistant polymer film 30 at a lower central surface of the elastic electric contact terminal.

In case of manufacturing the insulating foam rubber core 10 using elastic rubber having a low hardness and a high recovery rate into a small size, for example, within a width of about 2.5 mm and a height of about 2.2 mm, since the heat-resistant polymer film 30 including the metal layer 40 encloses almost the entire part of the elastic rubber except the front and rear ends in the length direction, elasticity and recovery rate of the elastic electric contact terminal are reduced as a whole. Also, a required force for pressing the elastic electric contact terminal increases. Especially when manufacturing a small-width elastic electric contact terminal, a non-foam rubber coating layer in a liquid state used for forming the non-foam insulating rubber coating layer 20 may leak through between the both ends of the heat-resistant polymer film 30 due to a pressure, remaining on the metal layer 40. When the rubber coating layer 20 is cured on the metal layer 40, soldering of the metal layer 40 may be poorly performed, thereby reducing the solder strength.

In addition, since both sides of the insulating foam rubber core 10 are enclosed by the metal layer 40, soldering may be performed up to a predetermined height of the both sides of the metal layer 40 due to a solder rise phenomenon. Therefore, if the elastic electric contact terminal has a height of about 2.2 mm or less, a pressed area, the elasticity, and the recovery rate are reduced whereas the required pressing force is increased.

Also, when the elastic electric contact terminal has a low height, the weight is reduced and it becomes hard to obtain reliable flatness of the lower surface. In this case, the elastic electric contact terminal may be displaced by air supplied during surface mounting and reflow soldering, resulting in reflow soldering defects.

According to Korean Utility Model No. 390490 filed by the present applicant, an electrically-conductive elastic rubber coating layer used for the elastic electric contact terminal has a greater electrical resistance than a general metal sheet. That is, the electrically-conductive elastic rubber coating layer, which is a compound of insulating elastic rubber coating materials such as an insulating silicon rubber coating material and silver powder, has a higher electrical resistance than metal. Such a material having a high electrical resistance is inadequate for an electrical contact because it increases power consumption and a contact resistance.

SUMMARY OF THE INVENTION

An object of the present invention is to provide a low-height elastic electric contact terminal having high elasticity, recovery rate, and electrical conductivity and requiring a small pressing force.

Another object of the present invention is to provide a low-height elastic electric contact terminal having a high recovery rate by maximizing an exposed area of a side surface of an elastic core, and requiring a small pressing force.

A further another object of the present invention is to provide a low-height elastic electric contact terminal facilitating tape and reel packaging thereof by pick-and-place by having the same upper and lower surface shapes and different left and right surface shapes.

A still another object of the present invention is to provide a low-height elastic electric contact terminal conveniently mounted to a facing object and easily manufactured at a low manufacturing cost.

A yet another object of the present invention is to provide a low-height elastic electric contact terminal improved in solder strength with respect to a facing object.

Yet still another object of the present invention is to provide a low-height elastic electric contact terminal facilitating surface mounting by pick-and-place and reflow soldering by a solder paste.

Still further another object of the present invention is to provide a low-height elastic electric contact terminal having a center of gravity at a lower part thereof so as to facilitate tape and reel packaging by pick-and-place but not to easily move during reflow soldering.

Still yet another object of the present invention is to provide a low-height elastic electric contact terminal minimizing solder rise occurring at lateral sides of a metal layer and affecting the elasticity, recovery rate, and required pressing force.

According to an aspect of the present invention, there is provided an elastic electric contact terminal including an elastic foam core having a sheet form, a non-foam rubber coating layer adhered to upper and lower surfaces of the elastic foam core and continued along any one side surface of the elastic foam core, and a heat-resistant polymer film, one side of which is adhered to the non-foam rubber coating layer in an enclosing manner and the other side of which is integrally formed with a metal layer.

According to another aspect of the present invention, there is provided an elastic electric contact terminal including an elastic foam core having a sheet form, a non-foam rubber coating layer adhered to upper and lower surfaces and any one side surface of the elastic foam in an enclosing manner, and a heat-resistant polymer film, one side of which is adhered to the non-foam rubber coating layer in an enclosing manner and the other side of which is integrally formed with a metal layer.

According to a further aspect of the present invention, there is provided an elastic electric contact terminal including an elastic foam core in the form of a sheet, a non-foam rubber coating layer adhered to upper and lower surfaces of the elastic foam core and continued along any one side surface of the elastic foam core, a support sheet disposed between any one of the upper and lower surfaces of the elastic foam core and the non-foam rubber coating layer, and an electrically conductive cloth, one side of which is adhered to the non-foam rubber coating layer in an enclosing manner.

Exemplarily, the heat-resistant polymer film may be curved into an arc at a part corresponding to the side of the elastic foam core.

The elastic foam core may be an insulating foam elastic rubber having an open-cell structure including a skin layer formed at upper and lower surfaces and a porous layer formed at side surfaces.

The non-foam rubber coating layer may be generated as a liquid insulating foam elastic rubber elastic rubber paste is cured and self-adhered between the elastic foam core and the heat-resistant polymer film.

The non-foam rubber coating layer may include magnetic or piezoelectric powder.

The heat-resistant polymer film integrally including the metal layer may be a flexible copper clad laminate (FCCL). Especially, the heat-resistant polymer film may include polyimide (PI) and an outermost layer of the metal layer may include any one of Sn, Ag, and Au.

The heat-resistant polymer film may be equal to or more than 5 times as thick as the metal layer.

The elastic electric contact terminal may further include a metal film adhered to an outer surface of the metal layer at a position corresponding to the lower surface of the elastic foam core. The metal layer and the metal film may be adhered to each other by an electrically conductive adhesive.

The electrically conductive adhesive may be a solder. The metal layer may be soldered by a solder paste.

The elastic electric contact terminal may have a height of about 2.2 mm or less.

The elastic electric contact terminal may be surface-mounted by pick-and-place and reflow-soldered by a solder paste.

The elastic electric contact terminal may further include a double-sided electrically-conductive adhesive tape adhered to an outer surface of the metal layer at a position corresponding to the lower surface of the elastic foam core.

The elastic electric contact terminal may further include an insulating solder-rise prevention line disposed at a part of the metal layer corresponding to the side surface of the elastic foam core to prevent solder rise.

The elastic foam core may have a lower hardness than the non-foam rubber coating layer.

The upper and lower surfaces of the elastic foam core may each include a skin layer and the side surfaces may each include a porous layer.

Optionally, the elastic electric contact terminal may further include a plurality of through holes formed through the metal layer and the insulating elastic core to correspond to the side surface of the elastic foam core in a length direction of the heat-resistant polymer film.

The elastic electric contact terminal may further include a solder-rise prevention line generated as a liquid non-foam rubber to form the non-foam rubber coating layer permeates through the through holes and cures.

The elastic electric contact terminal may be used as any one of an electrical ground, an electrical contact, an electrical tape, and an electromagnetic interference (EMI) gasket.

The elastic electric contact terminal may further include a support sheet adhesively disposed between any one of the upper and lower surfaces and the side surface of the elastic foam core.

The support sheet may be any one of the heat-resistant polymer film and the metal layer.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENT

Now, preferred embodiments of the present invention will be described in detail with reference to the accompanying drawings.

1. First Embodiment

Figure 1:
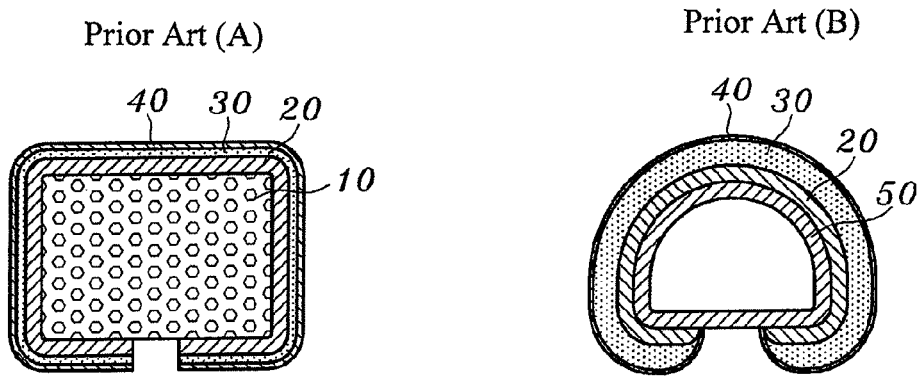
FIG. 1 is a view showing an elastic electric contact terminal according to a related art.
Figure 2:
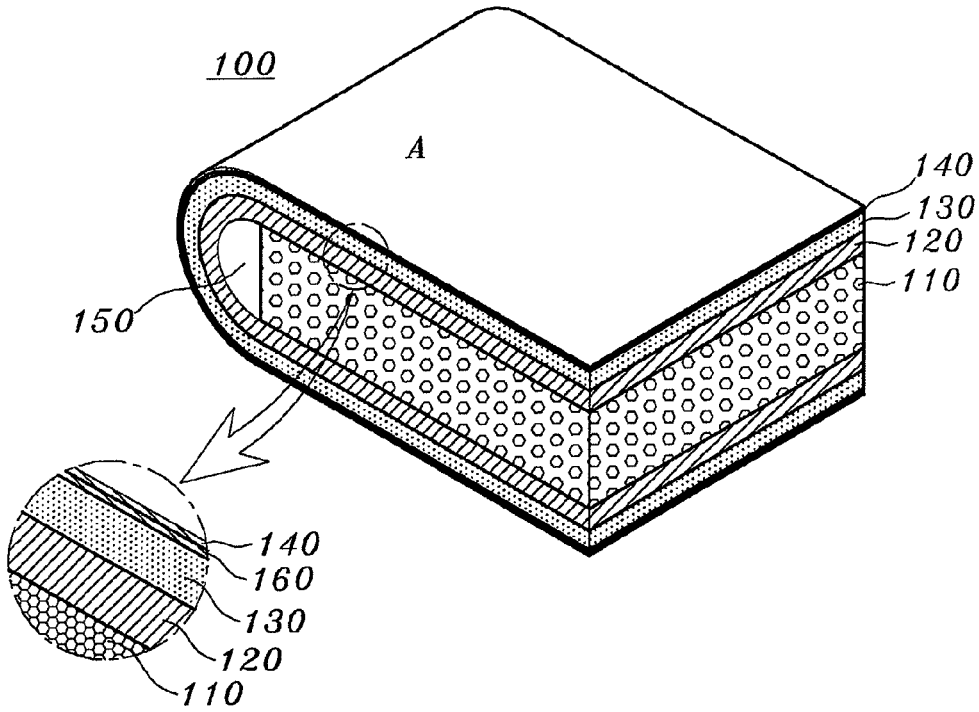
FIG. 2 shows an elastic electric contact terminal according to a first embodiment of the present invention.

FIG. 2 shows an elastic electric contact terminal 100 according to a first embodiment of the present invention.

The elastic electric contact terminal 100 includes an insulating elastic core 110 made of foam rubber, an insulating non-foam rubber coating layer 120, and a heat-resistant polymer film 130 including a metal layer 140 integrally formed with a rear side thereof.

Referring to FIG. 2, the heat-resistant polymer film 130 including the metal layer 140 is adhered through the insulating non-foam rubber coating layer 120 to enclose upper and lower surfaces and any one side surface of the insulating elastic core 110. The other side surfaces of the insulating elastic core 110 are exposed.

A part of the heat-resistant polymer film 130, which encloses the side surface of the insulating elastic core 110, is curved into an arc. According to the present embodiment, at the curved part, only the heat-resistant polymer film 130 is in adhesive contact with the insulating non-foam rubber coating layer 120. That is, a space 150 is generated between the insulating non-foam rubber coating layer 120 and the insulating elastic core 110.

Here, the insulating elastic core 110 has a lower hardness and a higher recovery rate than the insulating non-foam rubber coating layer 120.

According to the above structure, the insulating elastic core 110 is manufactured by slitting an elastic foam rubber sheet in a roll form, having a low height, a wide width, and plane upper and lower surfaces, into uniform lengths. Thus-manufactured insulating elastic core 110 requires a low manufacturing cost and has a right-angle cut surface. The insulating elastic core 110 is foamed to an open-cell structure, thereby obtaining high elasticity and recovery rate, and therefore is easily pressed even with a minor force. A skin layer is formed on the upper and lower surfaces of the open-cell insulating elastic core 110. In addition, a porous layer is formed on all the other surfaces generated by cutting.

The heat-resistant polymer film 130 including the thin metal layer 140 is adhered to the upper and lower surfaces of the insulating elastic core 110 having the sheet form through the insulating non-foam rubber coating layer 120 having elasticity. Accordingly, high elasticity and recovery rate can be obtained even with the low height. In addition, since the metal layer 140 is formed all over the lower surface, soldering efficiency and solder strength are high.

Additionally, since the heat-resistant polymer film 130 including the metal layer 140 is curved into an arc only at one side of the insulating elastic core 110, the elasticity and recovery rate of the elastic electric contact terminal 100 are increased. Also, a less force is required to press the elastic electric contact terminal 100.

Since the insulating elastic core 110 having the open-cell structure has a low hardness and high elasticity and recovery rate and requires a small pressing force, when the elastic electric contact terminal 100 is applied with an external force after being soldered, the external force is mostly absorbed by the insulating elastic core 110. As a result, an adhesive strength, that is, the solder strength of the elastic electric contact terminal 100 is enhanced.

In addition, at the curved part of the heat-resistant polymer film 130 which includes the metal layer 140, the insulating elastic core 110 is not adhered to the insulating non-foam rubber coating layer 120. Therefore, the space 150 is generated between the insulating non-foam rubber coating layer 120 and the insulating elastic core 110. Consequently, the elasticity and the recovery rate are increased while the required pressing force is reduced.

Furthermore, the insulating non-foam rubber coating layer 120 adhered with the heat-resistant polymer film 130 is also provided at the curved part of the heat-resistant polymer film 130 including the metal layer 140. Accordingly, the elasticity and the recovery rate are increased.

The heat-resistant polymer film 130 including the metal layer 140 does not enclose the other side surfaces of the insulating elastic core 110. Therefore, the elastic electric contact terminal 100 may more easily have a small size with high elasticity and recovery rate while requiring a small pressing force.

Also, since the heat-resistant polymer film 130 including the metal layer 140 does not enclose the other side surfaces of the insulating elastic core 110, solder rise is not generated at the metal layer 140 of the other side surfaces of the insulating elastic core 110 during soldering. Therefore, although the elastic electric contact terminal 100 has a low height, the soldered elastic electric contact terminal 100 may be pressed with a large area thereof. Additionally, the elasticity and the recovery rate are increased while the required pressing force is reduced.

In addition, since the heat-resistant polymer film 130 including the metal layer 140 encloses one side surface of the insulating elastic core 110 in an arc form, solder rise occurs at a lower part of the curved part of the metal layer 140 during soldering. Therefore, although the elastic electric contact terminal 100 has a low height, the pressed area of the soldered elastic electric contact terminal 100 is large. Additionally, the elasticity and the recovery rate are increased while the required pressing force is reduced.

Furthermore, since the heat-resistant polymer film 130 encloses one side of the insulating elastic core 110 in an arc form, tilting of the elastic electric contact terminal 100 may be prevented during reflow soldering.

The insulating non-foam rubber coating layer 120 having its own adhesive strength and elasticity is used as an adhesive for adhering the heat-resistant polymer film 130 to the insulating elastic core 110. Therefore, an adhesion force and the elasticity are maintained after the soldering and even after repetitive compression tests.

In addition, since the thin heat-resistant polymer film 130 including the metal layer 140 on the rear side thereof is used, the elastic electric contact terminal 100 is capable of maintaining the flexibility in spite of repeated compressions, obtaining an electrical conductivity by the metal layer 140, and undergoing soldering by a solder paste.

Although the insulating non-foam rubber coating layer 120 in the liquid form leaks through between the upper and lower surfaces of the insulating elastic core 110 and the heat-resistant polymer film 130, the leak may be partly received in the space 150. Therefore, the liquid insulating non-foam rubber coating layer 120 may be restricted from covering the metal layer 140 as much as possible. As a result, the solder strength may be enhanced.

Since the upper and lower surfaces of the elastic electric contact terminal 100 are plane, it is convenient to perform surface mounting technology (SMT) by pick-and-place and reflow soldering by a solder paste.

Hereinafter, component elements of the elastic electric contact terminal 100 according to the first embodiment will be described in detail.

1. 1. Insulating Elastic Core 110

Referring to FIG. 2, the insulating elastic core 110 disposed at an innermost position has plane upper and lower surfaces and takes the form of a sheet with a small thickness, for example, about 2.2 mm or less. The insulating elastic core 110 has a rectangular sectional shape in this embodiment although not limited thereto.

As described above, the insulating elastic core 110 may be an elastic body made of heat-resistant insulating silicon rubber and foamed into an open-cell structure. The skin layer is formed at the upper and lower surfaces of the insulating elastic core 110 while the porous layer is formed at all the side surfaces of the insulating elastic core 110.

According to the above structure, the silicon rubber in a liquid sate does not soak into the upper and lower surfaces of the insulating elastic core 110. Accordingly, elasticity and recovery rate of the elastic electric contact terminal 100 are improved and the required pressing force is reduced.

According to an exemplary embodiment, the insulating elastic core 110 may be an insulating silicon rubber foamed into the open-cell structure, having a hardness of about Shore A5 to A30 to meet the conditions of soldering including reflow soldering, the elasticity and recovery rate, and the pressing force.

Thus, when the open-cell elastic foam rubber having a low hardness and high elasticity and recovery rate is used for the insulating elastic core 110, the insulating elastic core 110 absorbs an external force applied to the elastic electric contact terminal 100 after soldered. As a result, the solder strength is increased.

In addition, since the open-cell elastic foam rubber is used for the insulating elastic core 110, when external heat is applied during reflow soldering of the elastic electric contact terminal 100, air contained in the open-cell structure is automatically discharged out, not expanding the insulating elastic core 110. Therefore, the elastic electric contact terminal 100 is not moved during reflow soldering and reflow soldering may be conveniently performed.

1. 2. Non-Foam Rubber Coating Layer 120

The non-foam rubber coating layer 120 is disposed between the insulating elastic core 110 and the heat-resistant polymer film 130 to achieve reliable elastic adhesion between the insulating elastic core 110 and the heat-resistant polymer film 130.

According to an exemplary embodiment, the non-foam rubber coating layer 120 is a non-foam insulating silicon rubber adhesive having its own elasticity and own adhesive strength in a cured state to be adhered to the insulating elastic core 110 and the heat-resistant polymer film 130.

The non-foam rubber coating layer 120 may be a curing adhesive adhered by curing, which is not melted by heat. Therefore, the adhesive strength is maintained before and after the soldering. The elasticity is also maintained.

To obtain desired elasticity and recovery rate, the non-foam rubber coating layer 120 completely cured may have a hardness in the range of about Shore A 20 to A 70 and a thickness of about 0.02 mm to 0.2 mm.

Exemplarily, the curing may be performed by thermal curing or infrared curing for fast processing.

Exemplarily, the non-foam rubber coating layer 120 may be formed by curing an insulating silicon rubber paste in a liquid state. The liquid insulating silicon rubber paste is adhered to a facing object while being cured and, after being cured, becomes the insulating non-foam rubber coating layer 120 in a solid state. Once cured, the insulating non-foam rubber coating layer 120 is not melted by heat. Therefore, the adhesive strength is maintained in the soldering heat. Also, the cured insulating silicon rubber paste has elasticity.

Exemplarily, the non-foam rubber coating layer 120 is endowed with magnetic or piezoelectric property after the curing. For this, magnetic powder or piezoelectric powder such as ferrite may be put in the liquid insulating silicon rubber. In this case, noise of a current in the metal layer 140 may be removed.

1. 3. Heat-Resistant Polymer Film 130

A highly heat-resistant polyimide (PI) may be used for the heat-resistant polymer film 130 although not limited thereto. In consideration of the elasticity, recovery rate, flexibility, pressing force, and mechanical strength of the elastic electric contact terminal 100, it is exemplary that the heat-resistant polymer film 130 has a thickness of about 0.02 to 0.05 mm.

As described above, the metal layer 140 is integrally formed with the rear side of the heat-resistant polymer film 130. Here, the metal layer 140 may be formed thin, for example to a thickness of about 0.006 mm or less, by metal sputtering and plating so that the elastic electric contact terminal 100 has high elasticity, recovery force, and solder strength while requiring a small pressing force.

A circle in FIG. 2 shows a portion A in an enlarging manner. The metal layer 140 may be manufactured by forming a sputtering layer 160 by sputtering metal on the heat-resistant polymer film 130 and then plating the sputtering layer 160 with solderable metal. According to this structure, the metal layer 140 may be securely adhered to the heat-resistant polymer film 130.

To reduce the manufacturing cost and obtain a high electrical conductivity, the sputtered metal layer may have a thickness equal to or less than ⅓ of a thickness of the plated metal layer.

The metal layer 140 may be formed to a thickness of about 0.001 to 0.006 mm in consideration of the flexibility, electrical conductivity, solderability, and solder strength.

Also, it is exemplary that the metal layer 140 is constituted by a plurality of metal layers. For example, one of the metal layers may be formed by Cu plating as a main part of the metal layer 140. The other layers may be disposed on the Cu plated layer to form outermost surfaces of the metal layer 140 and plated with any one of Sn, Ag, and Au to prevent corrosion and facilitate soldering using solder paste.

The heat-resistant polymer film 130 may be equal to or more than 5 times as thick as the metal layer 140 to secure economical mechanical strength and flexibility.

In addition, a predetermined part of the metal layer 140 may be removed by etching so as to enhance flexibility of the heat-resistant polymer film 130.

Furthermore, if the metal layer 140 is split by etching into a plurality of electrically insulated parts and if a conductive pattern to solder the elastic electric contact terminal 100 thereon is split into a plurality of conductive patterns having insulation gaps corresponding to the plurality of insulated parts, the elastic electric contact terminal 100 may function as a plurality of elastic electric contact terminals.

It is exemplary that the metal layer 140 has an electrical resistance of about 0.05Ω or less.

For example, the heat-resistant polymer film 130 including the metal layer 140 on the rear side may be a flexible copper clad laminate (FCCL).

1. 4. Manufacturing Method of the Elastic Electric Contact Terminal 100

Hereinafter, a manufacturing method for the elastic electric contact terminal 100 according to the first embodiment will be described.

A liquid silicon rubber paste, which is thermally cured, is cast into a coating layer with a thickness of about 0.02 mm to 0.15 mm by a casting machine. The liquid silicon rubber coating layer is applied on a surface of the heat-resistant polymer film 130 having a uniform width and including the metal layer 140 formed on the rear side thereof. The insulating elastic core 110 in the form of a reel, which is previously slit to the roll form with a height of about 2.2 mm or less, is disposed on the liquid silicon rubber coating layer. The insulating elastic core 110 is continuously enclosed by the liquid silicon rubber coating layer, passing through a jig.

Here, the heat-resistant polymer film 130 including the metal layer 140 needs to be curved into an arc to be able to return to its initial form when a force applied to the heat-resistant polymer film 130 including the metal layer 140 is removed.

The heat-resistant polymer film 130 has the width capable of covering upper and lower parts of the insulating non-foam rubber coating layer 120 and forming the space 150 at the curved part.

If the liquid silicon rubber coating layer is too thin, an adhesive strength between the insulating elastic core 110 and the heat-resistant polymer film 130 is reduced. On the other hand, if the liquid silicon rubber coating layer is too thick, not only does it take a long time to cure the liquid silicon rubber but also the liquid silicon rubber may bleed out of the heat-resistant polymer film 130, which may hinder the soldering.

Next, the heat-resistant polymer film 130 enclosing the insulating elastic core 110 is continuously placed in a mold having a similar size to the elastic electric contact terminal 100. In this state, the liquid silicon rubber coating layer disposed between the insulating elastic core 110 and the heat-resistant polymer film 130 is cured by heat and becomes the non-foam rubber coating layer 120. Here, while curing, the non-foam rubber coating layer 120 functions as an adhesive to adhere the insulating elastic core 110 and the heat-resistant polymer film 130 to each other. In other words, the liquid silicon rubber coating layer is thermally cured as passing through a high-temperature mold having a predetermined size and, during this, functions as an adhesive which adheres the insulating elastic core 110 to the heat-resistant polymer film 130. After cured, the liquid silicon rubber coating layer becomes the insulating non-foam rubber coating layer 120 having elasticity. The mold has approximately the same size as the elastic electric contact terminal 100.

Here, the mold temperature may be maintained at about 200° C. for fast curing of the liquid silicon rubber disposed in the mold.

Next, the liquid silicon rubber is separated from the high-temperature mold and cooled in an incompletely cured state. Then, due to recovery characteristics and minimum bending radius requirements, the heat-resistant polymer film 130 is not adhered to the side surface of the insulating elastic core 110 but forms the space 150 in the curved state while maintaining a contact with the upper and lower surfaces of the insulating elastic core 110.

Especially, since the upper and lower surfaces of the insulating elastic core 110 include the skin layer and the side surfaces include the porous layer, the liquid silicon rubber may soak into pores of the side surfaces. Therefore, the space 150 may be more easily formed.

The space 150 has a half-oval sectional shape. It is exemplary that a longer diameter of the half-oval is equal to a height of the insulating elastic core 110 and a shorter diameter does not exceed 1;4 of a width of the insulating elastic core 110. Therefore, the elasticity and recovery rate of the elastic electric contact terminal 100 are increased while the required pressing force is reduced.

The space 150 may be generated at the curved part in the following manner. A fluorine resin coated wire is disposed in advance at the side surface of the insulating elastic core 110. After the heat-resistant polymer film 130 is adhered to enclose the insulating elastic core 110 including the side surface, the wire is removed, thereby forming the space 150 in a predetermined size.

The elastic electric contact terminal 100 using the heat-resistant polymer film 130 including the metal layer 140 may crease when manufactured to have a long length. To this end, generally, the elastic electric contact terminal 100 is manufactured within a length of about 1 m and then cut into a final required length, for example, 3 mm.

Exemplary, the elastic electric contact terminal 100 manufactured as described above has a height of about 2.2 mm or less and horizontal plane upper and lower surfaces.

Since the upper and lower surfaces and one side surface of the elastic electric contact terminal 100 include the metal layer 140, the elastic electric contact terminal 100 may have an excellent electrical conductivity with the electrical resistance of about 0.05Ω or less. Also, solderability and solder strength are high.

According to the present embodiment, the metal layer 140 is formed by sputtering and electroplating and has the Sn-plated outermost layer. The heat-resistant polymer film 130 is made of PI and the insulating elastic core 110 and the insulating non-foam rubber coating layer 120 are made of an insulating silicon rubber. Therefore, electrical and mechanical properties are maintained before and after the soldering.

It is exemplary that the upper and lower surfaces of the elastic electric contact terminal 100 are horizontal planes to facilitate surface mounting by pick-and-place and reflow soldering by a solder paste.

For an actual example, the elastic electric contact terminal 100 may be manufactured with a density of about 260 g/cm$^3$, a tensile strength of about 0.45 kg/cm$^2$, an elongation of about 50%, and a compression load of about 0.035 kg/cm$^2$. In addition, the insulating elastic core 110 is foamed into the open-cell structure including the skin layers at the upper and lower surfaces and the porous layers at the side surfaces. The insulating elastic core 110 is about 1 mm thick, the insulating non-foam rubber coating layer 120 is about 20 μm thick, the heat-resistant polymer film 130 is about 25 μm thick, and the metal layer 140 is about 3 μm thick. Accordingly, the elastic electric contact terminal 100 has a height of about 1.2 mm, a width of about 3 mm, and a length of about 3 mm. With this structure, the recovery rate is about 95% or more, the required pressing force is about 900 g or less. The elastic electric contact terminal 100 can be pressed by about 0.4 mm to the maximum.

Although not shown, according to the present embodiment, a support sheet may be inserted and adhered between any one of the upper and lower surfaces of the insulating elastic core 110 and the insulating non-foam rubber coating layer 120.

The support sheet may have a thickness of about 20 μm to 90 μm, being made of a metal film or a heat-resistant polymer such as a PI film.

When the support sheet is applied, the insulating elastic core 110 having high elongation and elasticity is able to maintain its shape, for example, not to extend during the processing. Also, movement of the elastic electric contact terminal 100 by air supplied during the reflow soldering may be prevented by increasing the weight of elastic electric contact terminal 100.

The support sheet may be adhered to the insulating elastic core 110 as follows. For example, the support sheet including an adhesive is adhered by pressure to the upper or lower surface of the insulating elastic core 110 which is in the form of a roll with about a 500 mm width. Next, the support sheet is slit into lengths required for the elastic electric contact terminal 100, for example, into about 3 mm lengths. Accordingly, the support sheet having the same length as the insulating elastic core 110 is formed on the upper or lower surface of the insulating elastic core 110. Next, a non-foam elastic rubber coating layer may be formed on the insulating elastic core 110 including the support sheet and then the heat-resistant polymer film 130 including the metal layer 140 is formed thereon in an enclosing manner. Thus, the elastic electric contact terminal 100 is manufactured. Succeeding manufacturing processes are the same as those described above.

2. Second Embodiment

Figure 3:
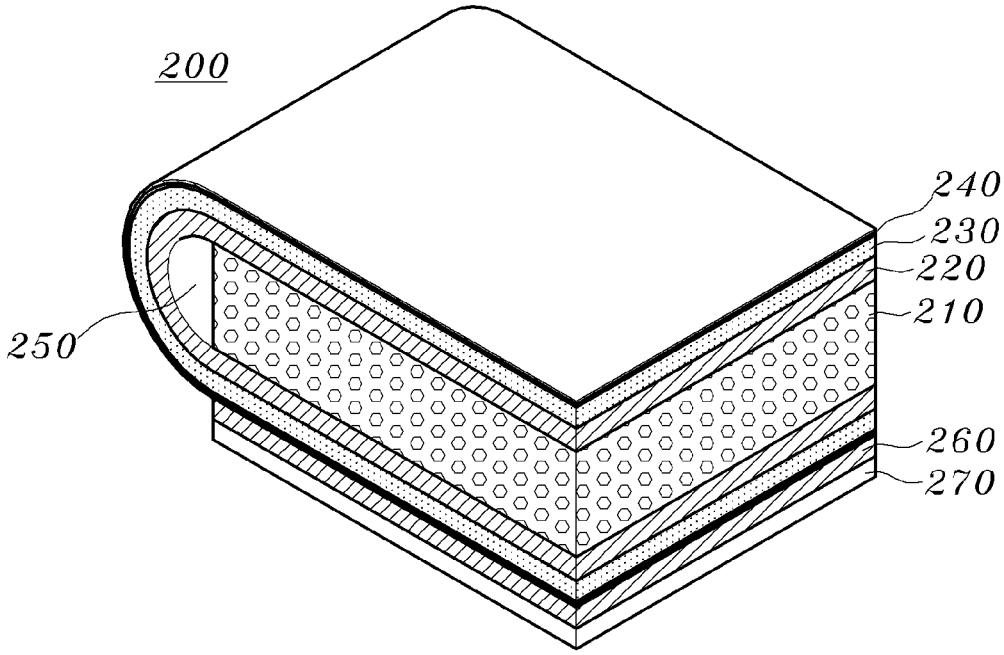
FIG. 3 shows an elastic electric contact terminal according to a second embodiment of the present invention.

FIG. 3 shows an elastic electric contact terminal 200 according to a second embodiment of the present invention.

Referring to FIG. 3, a solderable metal film 270 is adhered to an outer surface of a metal layer 240 at a position corresponding to a lower surface of an insulating elastic core 210.

The electrically conductive adhesive 260 may be any one of an electrically conductive silicon rubber adhesive, an electrically conductive epoxy adhesive, and a solder. The solder is recommended to reduce the electrical resistance.

It is exemplary that the solderable metal film 270 is made of any one of Cu and a Cu alloy to a thickness of about 0.01 mm to 0.08 mm.

It is exemplary that a surface of the solderable metal film 270 is plated with any one of Sn, Ag, and Au to prevent corrosion and facilitate the soldering.

It is exemplary that the metal film 270 has a similar width to the elastic electric contact terminal 200 so that the soldering using a solder paste does not affect the metal layer 240.

According to this structure, the tape and reel packaging becomes easier due to weight of the metal film 270 adhered to the metal layer 240. Also, the increased weight prevents movement of the elastic electric contact terminal 100 during surface mounting, thereby facilitating the reflow soldering and increasing the solder strength.

In addition, since the metal film 270 is soldered to a facing object, the solderability and solder strength are increased.

Furthermore, since solder is prevented from rising to the metal layer 240 enclosing a side surface of the elastic electric contact terminal 200, the elastic electric contact terminal 200 may be pressed with a large area thereof although it has a low height and may be easily pressed with a small force. Also, the elasticity and the recovery rate are increased. Especially, tilting of the elastic electric contact terminal 200 may be prevented during the reflow soldering.

3. Third Embodiment

Figure 4:
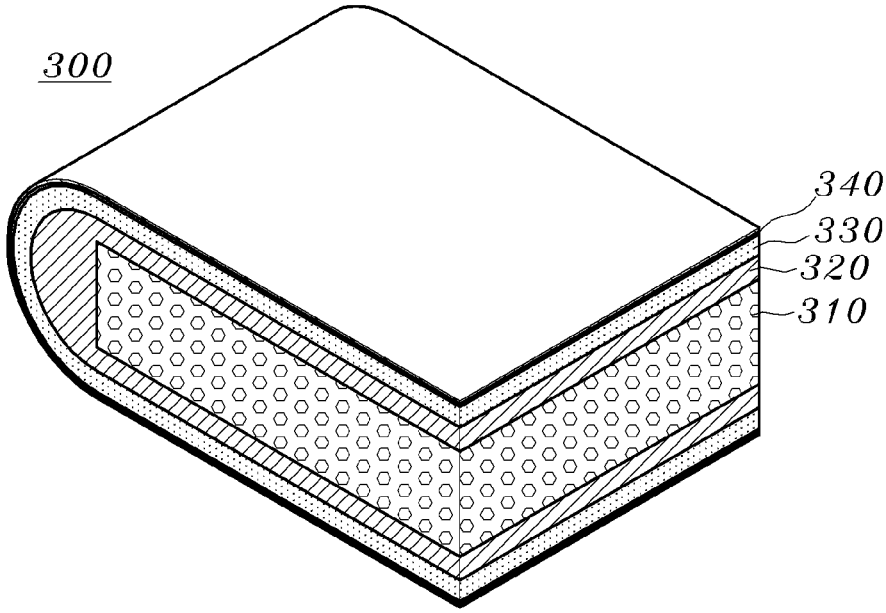
FIG. 4 shows an elastic electric contact terminal according to a third embodiment of the present invention.

FIG. 4 shows an elastic electric contact terminal 300 according to a third embodiment of the present invention.

Referring to FIG. 4, a non-foam rubber coating layer 320 is interposed and adhered between an insulating elastic core 310 and a heat-resistant polymer film 330 which includes a metal layer 340 formed thereon. The heat-resistant polymer film 330 encloses the insulating elastic core 310, being curved into an arc at one side of the insulating elastic core 310.

In comparison with the first embodiment shown in FIG. 2, the third embodiment does not have the space 150 of FIG. 2 because the side surface of the insulating elastic core 310 is adhered to the non-foam rubber coating layer 320.

The insulating elastic core 310 has a lower hardness and a higher recovery rate than the non-foam rubber coating layer 320.

According to this structure, since the heat-resistant polymer film 330 integrally formed with the metal layer 340 is curved into an arc and adhered to one side surface of the insulating elastic core 310 through the non-foam rubber coating layer 320, the elastic electric contact terminal 300 of the present embodiment requires a greater pressing force than the elastic electric contact terminal 100 of the first embodiment. However, manufacturing is easier.

The elastic electric contact terminal 300 also facilitates tape-and-tape and reel packaging by having a uniform appearance and an accurate size.

In addition, the elastic electric contact terminal 300 is relatively heavy and therefore not easily moved by air during the reflow soldering.

Hereinafter, a manufacturing method for the elastic electric contact terminal 300 will be described.

The elastic electric contact terminal 300 is manufactured in almost the same method as that of the elastic electric contact terminal 100 of the first embodiment. However, quantity of the liquid silicon rubber is increased or the mold size is decreased such that the insulating elastic core 310 and the heat-resistant polymer film 330 tightly contact each other and the space 150 as in the first embodiment is not generated. Additionally, the heat-resistant polymer film 330 having a sufficient width may be used to rather excessively enclose the insulating elastic core 310. The heat-resistant polymer film 330 may be cured in this state and adhered to three side surfaces of the insulating elastic core 310, and then cut out such that the other side surface of the insulating elastic core 310 are exposed.

Here, since the upper and lower surfaces of the insulating elastic core 310 include a skin layer and the side surfaces include a porous layer, the liquid silicon rubber coating material may soak into pores of the porous layers, which may increase the overall hardness of the elastic electric contact terminal 300. To this end, pressure and quantity of the liquid silicon rubber coating material needs to be properly controlled.

4. Fourth Embodiment

Figure 5:
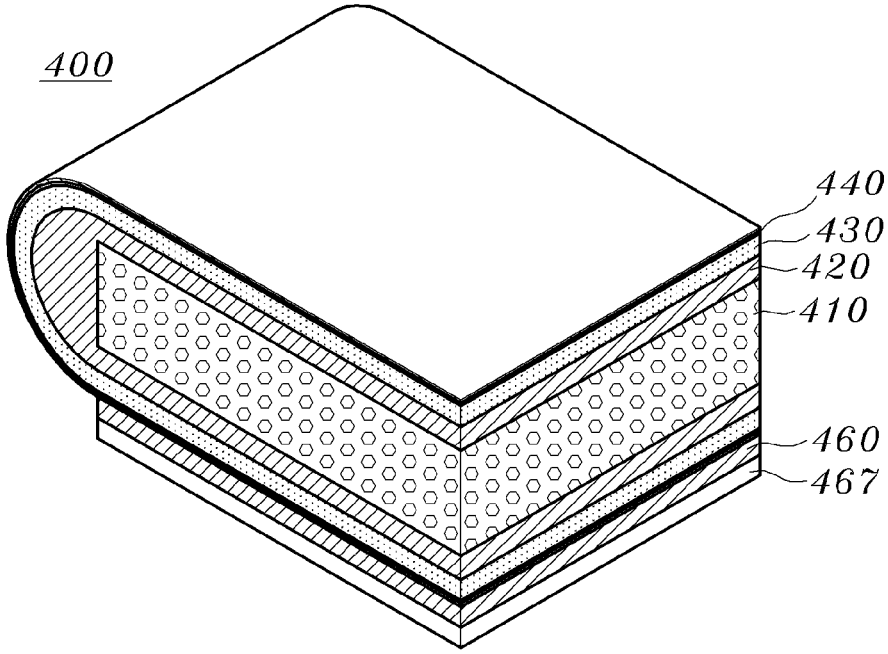
FIG. 5 shows an elastic electric contact terminal according to a fourth embodiment of the present invention.

FIG. 5 shows an elastic electric contact terminal 400 according to a fourth embodiment of the present invention.

According to FIG. 5, a solderable metal film 470 is adhered to an outer surface of a metal layer 440 at a position corresponding to a lower surface of an insulating elastic core 410.

The elastic electric contact terminal 400 has similar advantageous features to the elastic electric contact terminals 200 and 300 of FIGS. 3 and 4.

5. Fifth Embodiment

Figure 6:
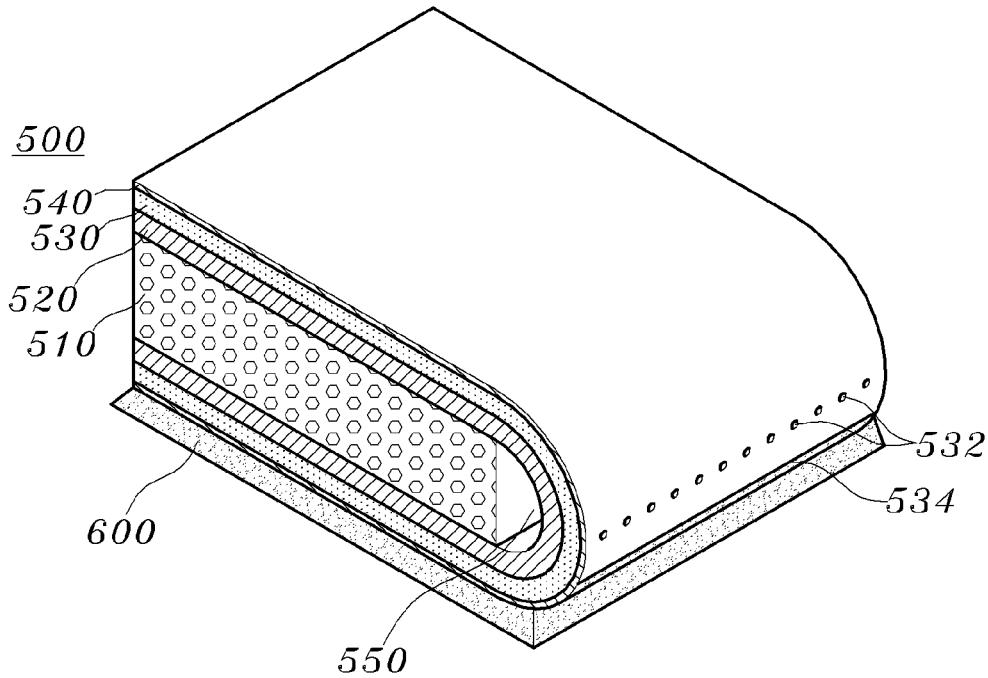
FIG. 6 shows a soldered state of an elastic electric contact terminal according to a fifth embodiment.

FIG. 6 shows an elastic electric contact terminal 500 and a solder 600 according to a fifth embodiment of the present invention.

Referring to FIG. 6, the elastic electric contact terminal 500 includes the solder 600 made of a solder paste. The elastic electric contact terminal 500 is soldered and fixed to a conductive pattern (not shown) of a printed circuit board (PCB) and brought into an elastic and electric contact with an electrically conductive object facing the PCB.

According to the present embodiment, a plurality of through holes 532 may be formed through an arc-curved part of a metal layer 540 and a heat-resistant polymer film 530 corresponding to a side surface of an insulating elastic core 510 in a length direction of the heat-resistant polymer film 530. The through holes 532 may improve the flexibility and the recovery rate of the elastic electric contact terminal 500 while reducing the required pressing force.

The through holes 532 have a size not allowing permeation of the liquid non-foam rubber for forming an insulating non-foam rubber coating layer 520. For example, the through holes 532 may have about a 30 μm size.

Additionally, according to the present embodiment, a solder rise prevention line 534 is formed at a lower part of the curved part of the metal layer 540 of the heat-resistant polymer film 530 enclosing a side surface of the insulating elastic core 510.

As generally known, the solder 600 may rise up to a predetermined height of the curved part of the metal layer 540 corresponding to the side surface, which may reduce the elasticity and recovery rate and increases the required pressing force of the elastic electric contact terminal 500.

However, the solder rise may be prevented by the solder rise prevention line 534. The solder rise prevention line 534 may be formed using a heat-resistant polymer paint or a liquid insulating non-foam rubber.

Also, in the same manner as in the embodiments of FIG. 3 and FIG. 5, a solderable metal film may be adhered to the lower part of the metal layer 540 to prevent the solder rise. However, since this method increases the manufacturing cost, the solder rise prevention line or the metal film may be selectively applied considering the size of the elastic electric contact terminal, the size of the space, the solder method, and so forth.

The solder rise prevention line 534 may be omitted and, instead, the through holes 532 may be formed at the position of the solder rise prevention line 534. The through holes 532 are formed to have a size allowing permeation of the liquid non-foam rubber that forms the insulating non-foam rubber coating layer 520. In this case, the liquid non-foam rubber that permeated the through holes 532 and cured may function as the solder rise prevention line.

6. Modified Embodiment

The previous embodiments have been explained as applying the heat-resistant polymer film integrally formed with the metal layer on the rear side thereof. However, if soldering is not considered, a flexible and thin electrically-conductive cloth may replace the heat-resistant polymer film including the metal layer, to enhance flexibility and elasticity.

Use of the electrically conductive cloth may improve the flexibility and the elasticity and, furthermore, reduce the manufacturing cost. However, the electrically conductive cloth may be frayed at a cut edge thereof or generate fluff on a surface thereof.

Exemplarily, the elastic foam core 110 has the open-cell structure in which the upper and lower surfaces include the skin layer and the side surfaces include the porous layer.

When the electrically conductive cloth is used, the support sheet may be interposed and adhered between at least one of the upper and lower surfaces of the elastic foam core 110 and the insulating non-foam rubber coating layer 120.

In addition, a double-sided electrically-conductive adhesive tape may be attached to an outer surface of the electrically conductive cloth, corresponding to the lower surface of the elastic foam core 110. The double-sided electrically-conductive adhesive tape may include any one of acrylic-base, urethane-base, and silicon-base electrically-conductive adhesive tapes.

According to the above structure, the elastic electric contact terminal is conveniently mounted even at a hard-to-solder position, especially, an object hard to apply reflow soldering by surface mounting. However, in case of using the adhesive tape, the electrical resistance and the adhesive strength of the elastic electric contact terminal may be deteriorated by the adhesive tape.

Furthermore, if soldering is not necessary, a polyethylene terephthalate (PET) film may substitute for the heat-resistant polymer film, with a metal layer formed on a rear side thereof. In this case, the material cost may be reduced.

According to the above description, the elastic electric contact terminal may have a low height and high elasticity, recovery rate, and electrical-conductivity, requiring a small pressing force and enabling soldering thereof.

Since the elastic electric contact terminal has a horizontal lower surface and includes only a metal layer, solder strength with respect to a facing object is high.

Since three sides of an elastic core are exposed, the recovery rate is improved and a small pressing force is required.

The elastic electric contact terminal may be conveniently surface-mounted through pick-and-place and reflow-soldered using a solder paste.

The solder rise may be minimized, which may occur at lateral sides of the metal layer and affect the elasticity, the recovery rate and the required pressing force.

Upper and lower surfaces of the elastic electric contact terminal have the same shape while left and right surfaces have different shapes. Therefore, tape and reel packaging becomes easier.

Since the elastic electric contact terminal has a center of gravity at a lower part thereof, pick-and-place tape and reel packaging is conveniently performed. Also, movement of the elastic electric contact terminal during reflow soldering is reduced.

In addition, the elastic electric contact terminal may be conveniently mounted to a facing object and conveniently manufactured at a low price.

While the present invention has been described in detail, it should be understood that various changes, substitutions and alterations can be made hereto without departing from the spirit and scope of the invention as defined by the appended claims.

What is claimed is:

1. An elastic electric contact terminal comprising:

an elastic foam core in the form of a sheet;

a non-foam rubber coating layer adhered to upper and lower surfaces of the elastic foam core and continued along any one side surface of the elastic foam core; and a heat-resistant polymer film, one side of which is adhered to the non-foam rubber coating layer in an enclosing manner and the other side of which is integrally formed with a metal layer, wherein the other side surface of the elastic foam core is exposed, and the heat-resistant polymer film is curved into an arc at a part corresponding to the one side surface of the elastic foam core.

2. The elastic electric contact terminal of claim 1, wherein the elastic foam core is an insulating foam elastic rubber having an open-cell structure comprising a skin layer formed at upper and lower surfaces and a porous layer formed at side surfaces.

3. The elastic electric contact terminal of claim 1, further comprising a metal film adhered to an outer surface of the metal layer at a position corresponding to the lower surface of the elastic foam core.

4. The elastic electric contact terminal of claim 3, wherein the metal layer and the metal film are adhered to each other by an electrically conductive adhesive.

5. The elastic electric contact terminal of claim 4, wherein the electrically conductive adhesive is a solder.

6. The elastic electric contact terminal of claim 1, further comprising a double-sided electrically-conductive adhesive tape adhered to an outer surface of the metal layer at a position corresponding to the lower surface of the elastic foam core.

7. The elastic electric contact terminal of claim 1, further comprising an insulating solder-rise prevention line disposed at a part of the metal layer corresponding to the side surface of the elastic foam core to prevent solder rise.

8. The elastic electric contact terminal of claim 1, wherein the elastic foam core has a lower hardness than the non-foam rubber coating layer.

9. The elastic electric contact terminal of claim 1, further comprising a plurality of through holes formed through the metal layer and the insulating elastic core to correspond to the side surface of the elastic foam core in a length direction of the heat-resistant polymer film.

10. The elastic electric contact terminal of claim 9, further comprising a solder-rise prevention line generated as a liquid non-foam rubber to form the non-foam rubber coating layer permeates through the through holes and cures.

11. The elastic electric contact terminal of claim 1, wherein the elastic electric contact terminal is used as any one of an electrical ground, an electrical contact, an electrical tape, and an electromagnetic interference (EMI) gasket.

12. The elastic electric contact terminal of claim 1, further comprising a support sheet adhesively disposed between any one of the upper and lower surfaces and the side surface of the elastic foam core.

13. The elastic electric contact terminal of claim 12, wherein the support sheet is any one of the heat-resistant polymer film and the metal layer.

14. An elastic electric contact terminal comprising:

an elastic foam core in the form of a sheet;

a non-foam rubber coating layer adhered to upper and lower surfaces and any one side surface of the elastic foam in an enclosing manner; and a heat-resistant polymer film, one side of which is adhered to the non-foam rubber coating layer in an enclosing manner and the other side of which is integrally formed with a metal layer, wherein the other side surface of the elastic foam core is exposed, and the heat-resistant polymer film is curved into an arc at a part corresponding to the one side surface of the elastic foam core.

15. An elastic electric contact terminal comprising:

an elastic foam core in the form of a sheet having an open-cell structure which comprises a skin layer formed at upper and lower surfaces and a porous layer formed at side surfaces;

a non-foam rubber coating layer adhered to upper and lower surfaces of the elastic foam core and continued along any one side surface of the elastic foam core;

a support sheet disposed between any one of the upper and lower surfaces of the elastic foam core and the non-foam rubber coating layer; and an electrically conductive cloth, one side of which is adhered to the non-foam rubber coating layer in an enclosing manner, wherein the other side surface of the elastic foam core is exposed, and the electrically conductive cloth is curved into an arc at a part corresponding to the one side surface of the elastic foam core.

16. The elastic electric contact terminal of claim 15, wherein the heat-resistant polymer film comprises PI or polyethylene terephthalate (PET).

* * * * *